US010494063B1

(12) United States Patent
Zhang et al.

(10) Patent No.: US 10,494,063 B1
(45) Date of Patent: Dec. 3, 2019

(54) OFFSHORE FLOATING DRILLING PLATFORM FOR OPERATION IN ICE-INFESTED WATERS AND HARSH ENVIRONMENT

(71) Applicant: China Merchants Heavy Industry (Jiangsu) Co., Ltd., Nantong, Jiangsu Province (CN)

(72) Inventors: Fan Zhang, Nantong (CN); Jinguang Wang, Nantong (CN); Siming Wang, Nantong (CN); Mingyuan Sun, Nantong (CN); Zhengquan Zhou, Nantong (CN); Lixin Xu, Nantong (CN); Jiancheng Liu, Nantong (CN)

(73) Assignee: China Merchants Heavy Industry (Jiangsu) Co., Ltd. (CN)

( * ) Notice: Subject to any disclaimer, the term of this patent is extended or adjusted under 35 U.S.C. 154(b) by 0 days.

(21) Appl. No.: 16/241,708

(22) Filed: Jan. 7, 2019

(30) Foreign Application Priority Data

Aug. 17, 2018 (CN) ..... 2018 1 0942281

(51) Int. Cl.

| | |
|---|---|
| ***B63B 35/03*** | (2006.01) |
| ***B63B 35/08*** | (2006.01) |
| ***B63B 35/44*** | (2006.01) |
| *E21B 7/128* | (2006.01) |

(52) U.S. Cl.
CPC ..... *B63B 35/083* (2013.01); *B63B 35/4413* (2013.01); *B63B 35/03* (2013.01); *E21B 7/128* (2013.01)

(58) Field of Classification Search
CPC ... B63B 35/44; B63B 35/083; B63B 35/4413; B63B 35/03; E21B 7/128
See application file for complete search history.

(56) References Cited

U.S. PATENT DOCUMENTS

| | | | | |
|---|---|---|---|---|
| 4,434,741 | A * | 3/1984 | Wright | B63B 35/08 114/264 |
| 4,808,036 | A * | 2/1989 | Bhalaik | E02B 17/0021 405/207 |
| 7,958,835 | B2 * | 6/2011 | Srinivasan | B63B 35/44 114/125 |
| 2013/0160693 | A1 * | 6/2013 | Roodenburg | B63B 35/4413 114/265 |

(Continued)

*Primary Examiner* — Stephen P Avila
(74) *Attorney, Agent, or Firm* — PROI Intellectual Property US

(57) ABSTRACT

An offshore floating platform for operating in ice-infested waters and harsh environment for oil/gas drilling and exploration in Arctic area comprises four (4) sections, i.e., an upper cone, a transition section, a lower cone and a bottom frame. The upper cone, the transition section, the lower cone and the bottom frame are coincident with a centerline, and a through center well is designed around the centerline from top to bottom. The diameter at the bottom frame is smaller than that of the main body of the center well. The upper cone, the transition section and the lower cone are internally connected and divided into plural compartments. Through ballast compartments are designed outside the sidewall of the upper cone, the transition section and the lower cone vertically connected with a consistent cross-sectional area from top to bottom. Plural ballast compartments and void compartments are arranged within the bottom frame.

10 Claims, 3 Drawing Sheets

(56) References Cited

U.S. PATENT DOCUMENTS

2015/0175246 A1* 6/2015 Huang ..... B63B 35/4413
114/264
2019/0016418 A1* 1/2019 Vandenworm ..... E21B 19/20

* cited by examiner

OFFSHORE FLOATING DRILLING PLATFORM FOR OPERATION IN ICE-INFESTED WATERS AND HARSH ENVIRONMENT

TECHNICAL FIELD

This invention relates to the field of offshore oil/gas drilling equipment, particularly to an offshore floating drilling platform for operation in ice-infested waters and harsh environment in polar regions.

BACKGROUND OF THE INVENTION

Oil and gas resources in Arctic area can play a substantial role in meeting future global energy demand. Norwegian Sea and North Sea close to Arctic area are promising areas rich in oil/gas reserves. However, the severe environmental conditions in these areas raise challenges to oil/gas exploration and production. In Arctic area, ice flows and harsh weather conditions occur simultaneously or alternatively, creating barriers to the traditional semi-submersible drilling rigs, drilling ships and other floating structures. When facing the ice flows, the semi-submersible drilling rigs and drilling ships have to be removed from the site until the ice is melted and the area is suitable for further operations. This causes large operation-hour loss. Consequently, it extends the exploration period of project and increases the investment.

Furthermore, although the existing drilling rigs and production platforms for harsh environment have favorable motion performance, they are lack of ice resistance capability. Therefore, there is a current demand for a floating platform with ice resistance capability and outstanding motion response in harsh environment.

SUMMARY OF THE INVENTION

The main object of the present invention is to introduce an offshore drilling platform with both excellent motion performance in harsh environment and ice resistance capacity, so as to avoid large operation-hour loss and standby duration.

The technical scheme of this invention is as follows:

An offshore floating platform for oil/gas drilling and exploration in ice-infested waters and harsh environment, comprising an upper cone, a transition section, a lower cone and a bottom frame from top to bottom; the said upper cone is an inverse frustum, and the lower cone is a normal frustum; the transition section is an inverse frustum; the top surface of the transition section is coincident with the bottom surface of the upper cone, and the bottom surface of the transition section is coincident with the top surface of the lower cone; the size of the bottom frame is larger than that of the bottom surface of the lower cone; the said upper cone, the transition section, the lower cone and the bottom frame are coincident with a centerline; a through center well is designed around the centerline from top to bottom; the diameter at the bottom frame is smaller than that of the main body of the center well; the upper cone, the transition section and the lower cone are internally connected and divided into plural compartments. Through ballast compartments are designed outside the sidewall of the upper cone, the transition section and the lower cone; the top of the ballast compartments is flush with the upper surface of the upper cone, and the bottom of the ballast compartments is connected with the top of the bottom frame; the ballast compartments are internally connected from top to bottom; the cross-sectional area of the ballast compartments is consistent at any elevation; plural ballast compartments and void compartments are arranged within the bottom frame; and plural compartments are arranged with the upper cone, the lower cone and the transition section to store oil, ballast and other fluids. The ballast compartments with the same cross-sectional area at any elevation can ensure the overall shape of the upper cone, the transition section and the lower cone at the outmost side of the drilling platform. With this external profile, the drilling platform can operate in the harsh environment and under the ice conditions in Arctic area.

Further, the upper cone, the transition section, the lower cone and the bottom frame are of circular frustum or regular polygonal frustum, preferably circular frustum.

Further, the side dip angle of the transition section is different from that of the upper cone.

Further, the height of the transition section accounts for less than 20% of the total height of the said upper cone, the transition section, the lower cone and the bottom frame.

Further, the side dip angle of the upper cone is larger than or equal to 30 degrees.

Further, the side dip angle of the lower cone is larger than 30 degrees.

Further, a mooring cable conduit is arranged within the ballast compartments from top to bottom; the end of the mooring cable conduit passing through the bottom frame is communicated with seabed; a mooring cable is arranged within and along the mooring cable conduit; the upper end of the mooring cable penetrates out of the top of the ballast compartments; and the lower end of the mooring cable penetrates out of the bottom of the mooring cable conduit.

Further, the mooring cable is of chain-cable-chain type.

Further, the platform has plural ballast compartments distributed in the horizontal plane.

Further, the void compartments are arranged around the center well.

Further, the floating drilling platform serves offshore oil/gas drilling and exploration.

In services, the floating drilling platform has three drafts under different operation conditions. In open waters, the platform is in the normal operation draft condition. The water plane is at the transition section. In ice-infested waters, the platform is in the ice operation draft condition with the water plane located at the upper cone. In extreme environmental conditions, the platform is in the survival draft condition with the water plane located at the lower cone.

The main benefits of the proposed drilling platform are summarized as follows:

1) The transition section is used to connect the upper cone and the lower cone. A transition section of circular frustum can reduce the water plane area;

2) A variable cross-section center well houses the drilling riser and shields the riser from ice flows;

3) The upper cone has an exterior plane downwardly and inwardly inclined, and this section will be the draft under the ice-infested condition;

4) The recommended inclined plane of the upper cone can cause flexural damage to the ice sheets or ice flows. This profile type can remarkably reduce the ice load of the platform compared to the vertical cylindrical type of the same dimensions;

5) The upper cone can provide foundation and space for the drilling rig and other facilities;

6) The lower cone can provide buoyancy force for the platform with fixed ballast or ballast water, and other liquids stored in the compartments;

7) The lower cone has an exterior inclined plane. The center of gravity of the profile type can be lowered than that of a normal cylindrical type. And the stability property of the platform can be increased;

8) A large-diameter bottom frame of horizontal circular frustum is designed to increase the added mass and damping of the platform;

9) The center well is designed to have a variable cross section. The diameter at the bottom frame is smaller than that at other sections of the platform. The small diameter of the center well can entrap water in the center well;

10) A chain-cable-chain mooring system is adopted to withstand the large ice load and environmental load;

11) Both the center well and the main structure of the platform have a large size, and their relation can be optimized by the technique well known to those skilled in the art to provide enough stability;

12) To protect the mooring cable from ice impact, the mooring cable arranged within and along the mooring cable conduit is connected to the mooring equipment.

Wherein, 1 is the compartment, 2 is the compartment, 3 is the upper cone, 4 is the transition section, 5 is the lower cone, 6 is the bottom frame, 7 is the center well, 8 is the ballast compartment and 9 is the ballast compartment within bottom frame.

DETAILED DESCRIPTION OF THE INVENTION

The technical properties and advantages of the invention are described in detail as follows.

Figure 1:
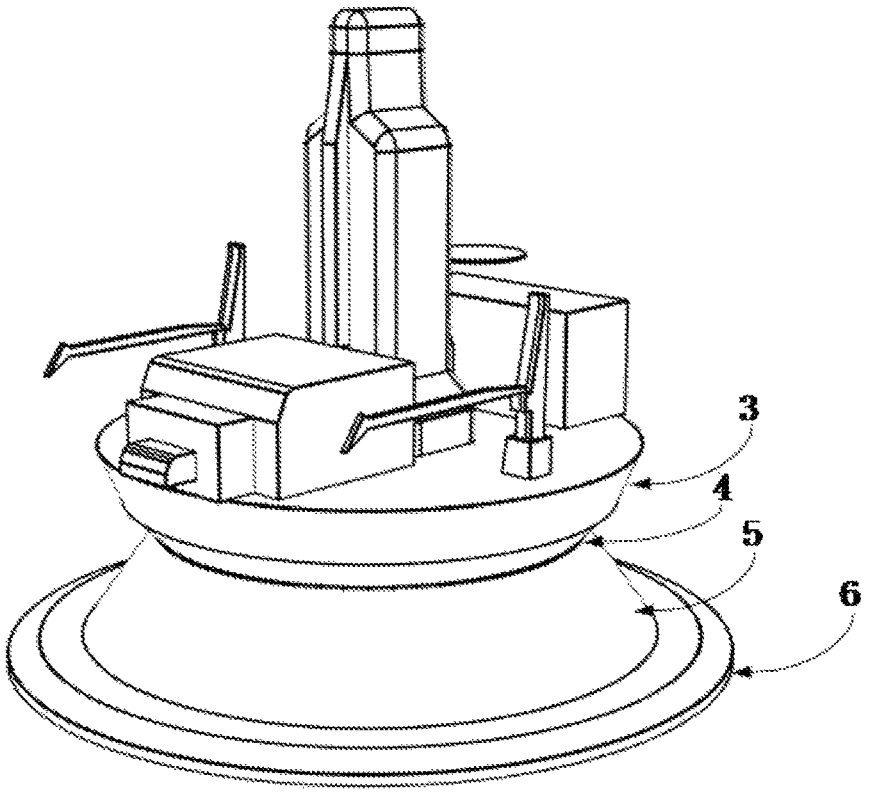
FIG. 1 is the 3D structural diagram of the offshore drilling platform for ice-infested waters and harsh environment of the present invention.
Figure 2:
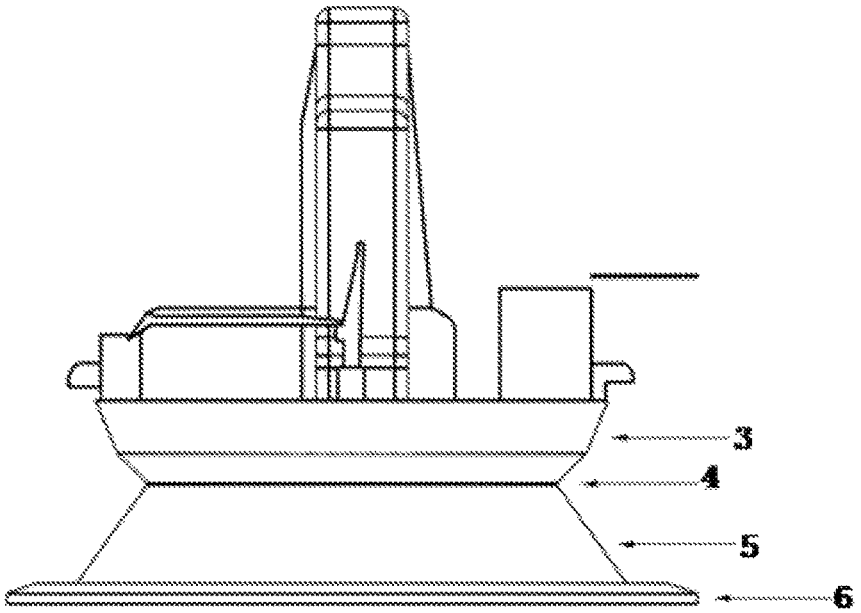
FIG. 2 is the side view of the offshore drilling platform for ice-infested waters and harsh environment.
Figure 3:
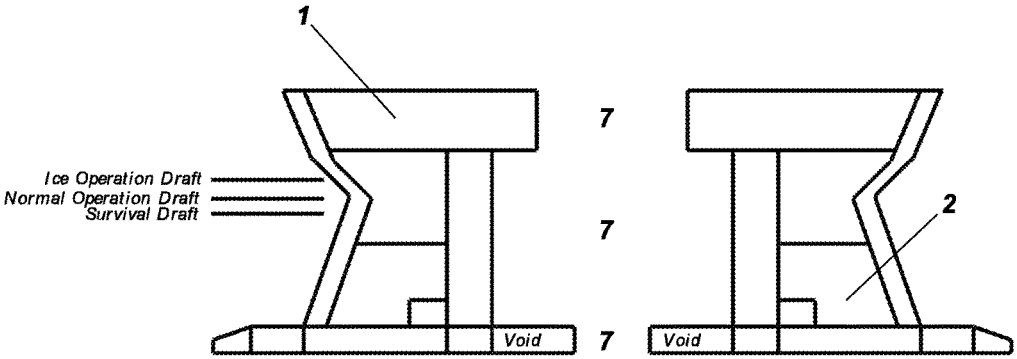
FIG. 3 is the cross-section view of the offshore drilling platform for ice-infested waters and harsh environment.
Figure 4:
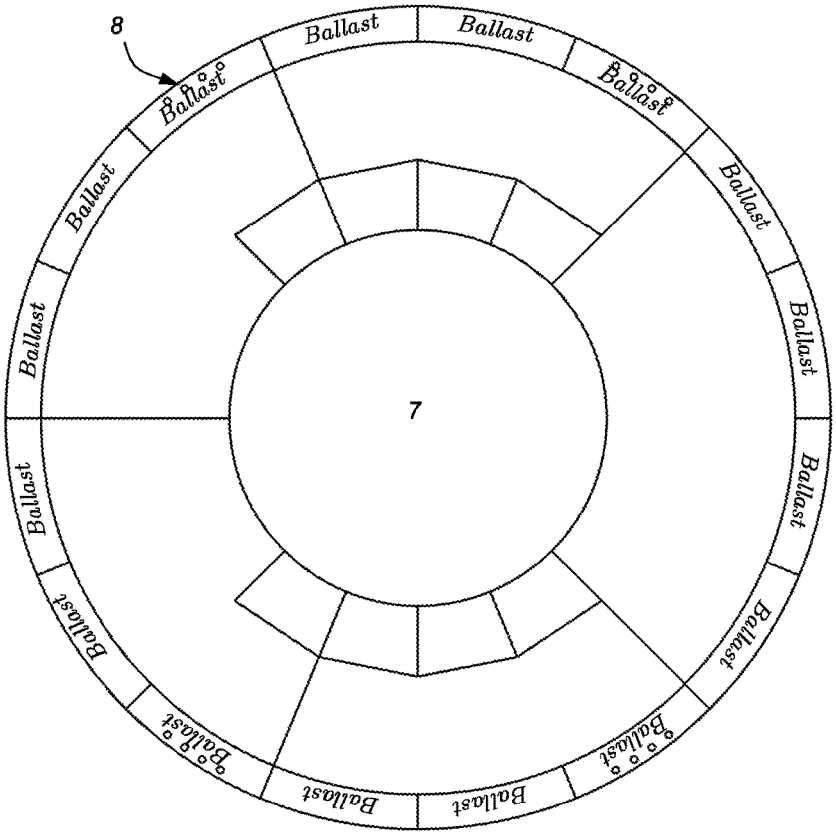
FIG. 4 is the cross-section view of the transition section.
Figure 5:
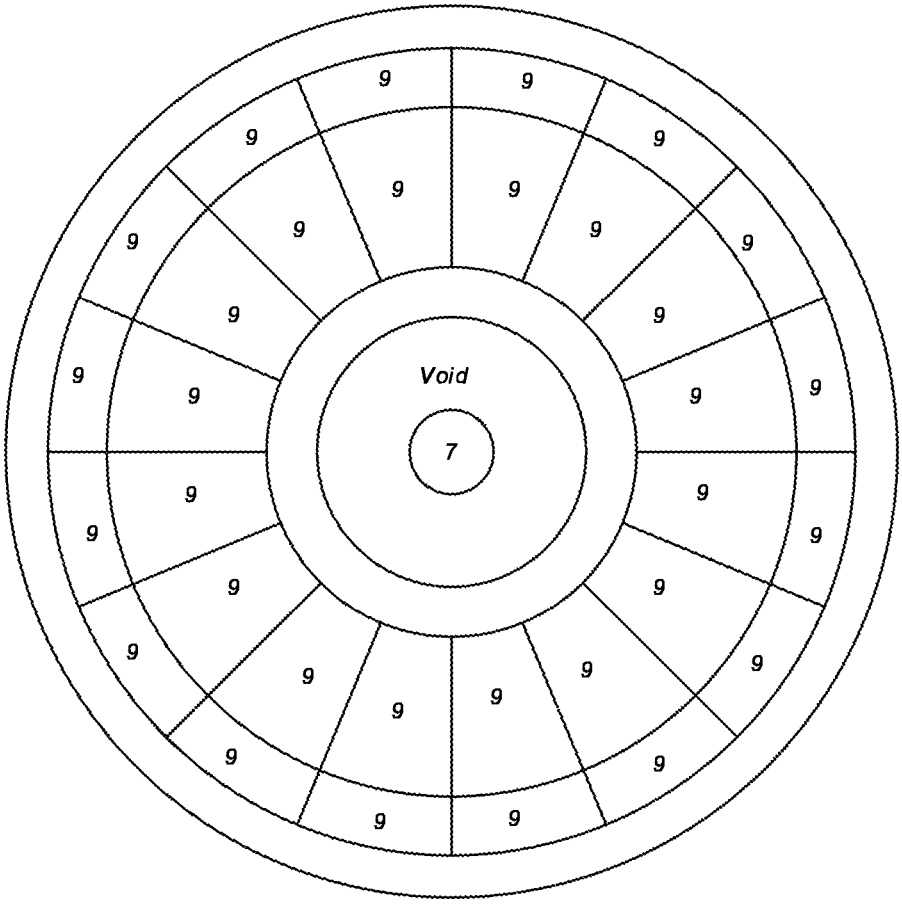
FIG. 5 is the cross-section view of the bottom frame.

As shown in FIGS. 1-4, an offshore floating platform for oil/gas drilling and exploration in ice-infested waters and harsh environment is provided, comprising an upper cone, a transition section, a lower cone and a bottom frame from top to bottom; the said upper cone is an inverse frustum, and the lower cone is a normal frustum; the transition section is an inverse frustum; the top surface of the transition section is coincident with the bottom surface of the upper cone, and the bottom surface of the transition section is coincident with the top surface of the lower cone; the size of the bottom frame is larger than that of the bottom surface of the lower cone; the said upper cone, the transition section, the lower cone and the bottom frame are coincident with a centerline; a through center well is designed around the centerline from top to bottom; the diameter at the bottom frame is smaller than that of the main body of the center well; the upper cone, the transition section and the lower cone are internally connected and divided into plural compartments. Through ballast compartments are designed outside the sidewall of the upper cone, the transition section and the lower cone; the top of the ballast compartments is flush with the upper surface of the upper cone, and the bottom of the ballast compartments is connected with the top of the bottom frame; the ballast compartments are internally connected from top to bottom; the cross-sectional area of the ballast compartments is consistent at any elevation; plural ballast compartments and void compartments are arranged within the bottom frame; and plural compartments are arranged with the upper cone, the lower cone and the transition section to store oil, ballast and other fluids. The ballast compartments with the same cross-sectional area at any elevation can ensure the overall shape of the upper cone, the transition section and the lower cone at the outmost side of the drilling platform. With this external profile, the drilling platform can operate in the harsh environment and under the ice conditions in Arctic area.

The upper cone, the transition section, the lower cone and the bottom frame are of circular frustum or regular polygonal frustum, preferably circular frustum.

The side dip angle of the transition section is different from that of the upper cone.

The height of the transition section accounts for less than 20% of the total height of the said upper cone, the transition section, the lower cone and the bottom frame.

The side dip angle of the upper cone is larger than or equal to 30 degrees.

The side dip angle of the lower cone is larger than 30 degrees.

A mooring cable conduit is arranged within the ballast compartments from top to bottom; the end of the mooring cable conduit passing through the bottom frame is communicated with seabed; a mooring cable is arranged within and along the mooring cable conduit; the upper end of the mooring cable penetrates out of the top of the ballast compartments; and the lower end of the mooring cable penetrates out of the bottom of the mooring cable conduit.

The mooring cable is of chain-cable-chain type.

The platform has plural ballast compartments distributed in the horizontal plane.

The void compartments are arranged around the center well.

The floating drilling platform serves offshore oil/gas drilling and exploration.

In services, the floating drilling platform has three drafts under different operation conditions. In open waters, the platform is in the normal operation draft condition. The water plane is at the transition section. In ice-infested waters, the platform is in the ice operation draft condition with the water plane located at the upper cone. In extreme environmental conditions, the platform is in the survival draft condition with the water plane located at the lower cone.

The transition section is used to connect the upper cone and the lower cone. A transition section of circular frustum can reduce the water plane area.

A variable cross-section center well houses the drilling riser and shields the riser from ice flows.

The upper cone has an exterior plane downwardly and inwardly inclined, and this section will be the draft under the ice-infested condition.

The recommended inclined plane of the upper cone can cause flexural damage to the ice sheets or ice flows. This profile type can remarkably reduce the ice load of the platform compared to the vertical cylindrical type of the same dimensions.

The upper cone can provide foundation and space for the drilling rig and other facilities.

The lower cone can provide buoyancy force for the platform with fixed ballast or ballast water, and other liquids stored in the compartments.

The lower cone has an exterior inclined plane. The center of gravity of the profile type can be lowered than that of a normal cylindrical type. And the stability property of the platform can be increased.

A large-diameter bottom frame of horizontal circular frustum is designed to increase the added mass and damping of the platform.

The center well is designed to have a variable cross section. The diameter at the bottom frame is smaller than that at other sections of the platform. The small diameter of the center well can entrap water in the center well.

A chain-cable-chain mooring system is adopted to withstand the large ice load and environmental load.

Both the center well and the main structure of the platform have a large size, and their relation can be optimized by the technique well known to those skilled in the art to provide enough stability.

To protect the mooring cable from ice impact, the mooring cable arranged within and along the mooring cable conduit is connected to the mooring equipment.

The center well 7 can entrap water inside. The entrapped water is used as the ballast for the platform to increase its added mass and its inertial property. As the inertial property of the platform is enlarged, the effect of ice sheets or ice flows on the platform is further decreased.

The mooring system is essential for the positioning of the drilling platform especially when the drilling platform is acted by huge ice load in ice-infested waters. To protect the mooring system from ice impact, the mooring cable arranged within and along the mooring cable conduit is connected to the mooring equipment.

This invention provides an offshore floating platform with a bi-conical structure for oil/gas drilling and exploration. The center well is arranged around the centerline of the platform to house and shied the drilling riser from ice impact. The center well also reduces the water plane area.

Two operation drafts are designed for the platform. In open waters, the platform is in the normal operation draft condition. The water plane is at the transition section. In ice-infested waters, the platform is in the ice operation draft condition with the water plane located at the upper cone.

The above description only presents the preferred embodiment of the present invention, not intending to limit its scope. All improvements and changes performed as per the main spirit of the present invention shall fall within the protection scope determined by the claims of the present invention.

What is claimed is:

1. An offshore floating platform for oil/gas drilling and exploration in ice-infested waters and harsh environment, wherein a main structure off the platform comprises an upper cone, a transition section, a lower cone, and a bottom frame from top to bottom; the upper cone is an inverse frustum, and the lower cone is a normal frustum; the transition section is an inverse frustum; a top surface of the transition section is coincident with a bottom surface of the upper cone, and a bottom surface of the transition section is coincident with a top surface of the lower cone; a size of the bottom frame is larger than that of the bottom surface of the lower cone; the upper cone, the transition section, the lower cone and the bottom frame are coincident with a centerline; a through center well is designed around the centerline from top to bottom; a diameter at the bottom frame is smaller than that of a main body of the center well; the upper cone, the transition section and the lower cone are internally connected and divided into plural compartments; through ballast compartments are designed outside a sidewall of the upper cone, the transition section and the lower cone; a top of the ballast compartments is flush with an upper surface of the upper cone, and the bottom of the ballast compartments is connected with a top of the bottom frame; the ballast compartments are internally connected from top to bottom; a cross-sectional area of the ballast compartments is consistent at any elevation; plural ballast compartments and void compartments are arranged within the bottom frame.

2. The offshore floating drilling platform for operation in ice-infested waters and harsh environment according to claim 1, wherein the upper cone, the transition section, the lower cone and the bottom frame are of circular frustum or regular polygonal frustum, preferably circular frustum.

3. The offshore floating drilling platform for operation in ice-infested waters and harsh environment according to claim 1, wherein a side dip angle of the transition section is different from that of the upper cone.

4. The offshore floating drilling platform for operation in ice-infested waters and harsh environment according to claim 1, wherein a height of the transition section accounts for less than 20% of a total height of the upper cone, the transition section, the lower cone and the bottom frame.

5. The offshore floating drilling platform for operation in ice-infested waters and harsh environment according to claim 1, wherein a side dip angle of the upper cone is larger than or equal to 30 degrees.

6. The offshore floating drilling platform for operation in ice-infested waters and harsh environment according to claim 1, wherein a side dip angle of the lower cone is larger than 30 degrees.

7. The offshore floating drilling platform for operation in ice-infested waters and harsh environment according to claim 1, wherein a mooring cable conduit is arranged within the ballast compartments from top to bottom; an end of the mooring cable conduit passing through the bottom frame is communicated with seabed; a mooring cable is arranged within and along the mooring cable conduit; an upper end of the mooring cable penetrates out of a top of the ballast compartments; and a lower end of the mooring cable penetrates out of a bottom of the mooring cable conduit.

8. The offshore floating drilling platform for operation in ice-infested waters and harsh environment according to claim 1, wherein the mooring cable is of chain-cable-chain type.

9. The offshore floating drilling platform for operation in ice-infested waters and harsh environment according to claim 1, wherein the void compartments are arranged around the center well.

10. The offshore floating drilling platform for operation in ice-infested waters and harsh environment according to claim 1, wherein the floating drilling platform serves offshore oil/gas drilling and exploration.

* * * * *